US005716228A

United States Patent [19]

Chen

[11] Patent Number: 5,716,228

[45] Date of Patent: Feb. 10, 1998

[54] COMPUTER PLUG CONNECTOR FASTENING MECHANISM

[76] Inventor: John Chen, 1st Fl., No. 2, Alley 9, Lane 45, Pao-Hsin Road, Hsin-Tien, Taipei, Taiwan

[21] Appl. No.: 230,011

[22] Filed: Apr. 19, 1994

[51] Int. Cl.[6] ..... H01R 13/627

[52] U.S. Cl. ..... 439/358

[58] Field of Search ..... 439/350, 351, 439/352, 354, 357, 358, 353, 355, 356

[56] References Cited

U.S. PATENT DOCUMENTS

| | | | |
|---|---|---|---|
| 5,167,523 | 12/1992 | Crimmins et al. | 439/358 |
| 5,178,556 | 1/1993 | Chen | 439/357 |
| 5,199,897 | 4/1993 | Hishiguchi | 439/357 |
| 5,201,669 | 4/1993 | Lin | 439/357 |

*Primary Examiner*—Gary F. Paumen
*Assistant Examiner*—Hien D. Vu
*Attorney, Agent, or Firm*—Pro-Techtor International

[57] ABSTRACT

A computer plug connector fastening mechanisms comprising two rectangular frames formed in an outer shell of a computer plug connector at two opposite lateral sides. The frames have two clamp holders respectively fastened therein to hold two clamping devices which are inserted therethrough for clamping the computer plug connector to a computer plug socket. The clamp holders each ave two parallel side walls on which a hook portion is formed to engage to elongated grooves on the inner wall surface of the frames. A front portion of the clamp holders includes an inward raised portion, an insertion hole, a through hole, a stopper, and a projected hook. The clamping devices each have a metal clamping plate which has hole near its front and includes an inward and forward extended L-shaped hook plate that includes an oblique hook. When the clamping devices are inserted into the slots of the plug connector shell, the L-shaped hook plates and the oblique hooks pass through the insertion holes and the through holes on the raised portions of the clamp holders, respectively, while the oblique hooks are retained by the stoppers. The front holes engage with the projected hooks of the raised portions of the clamp holders, permitting the computer plug connector to be quickly and firmly connected to a computer socket connector.

2 Claims, 4 Drawing Sheets

COMPUTER PLUG CONNECTOR FASTENING MECHANISM

BACKGROUND OF THE INVENTION

The present invention relates to a computer plug connector fastening mechanism and more particularly is a computer plug connector fastening mechanism for securing a computer plug connector to a computer socket connector in a quick and firm manner.

FIG. 1 illustrates a computer plug connector fastening mechanism (which was invented by the present inventor). The mechanism is comprised of two unitary clamp holders formed on the metal casing of the connector, which is covered within a plastic outer shell, and two clamping elements fastened in said two clamp holders. Squeezing a top end of the clamping elements inward causes the lower ends to extend outward. The clamping elements on the computer plug connector can then be connected to the clamping elements on the computer socket connector to which the computer plug connector is connected. The main disadvantage of this structure of computer plug connector fastening mechanism is its relatively high manufacturing cost.

FIG. 2 illustrates another structure of computer plug connector fastening mechanism (which was also invented by the present inventor). In this structure of computer plug connector fastening mechanism, two clamping devices are attached to the plastic outer shell which is directly molded onto the metal casing of the plug connector. The two clamping devices each have a lateral unitary tubular portion in a central portion of the metal clamping plate thereof which is secured in a groove on the plastic outer shell. The main disadvantage of this structure of computer plug connector fastening mechanism is that the two clamping devices can be easily loosened, thereby causing fastening problems. Another disadvantage of this structure of computer plug connector fastening mechanism is that the clamping devices provide less spring force for the clamping operation because they are attached to the plastic outer shell but not the metal casing of the computer plug connector. Further, while squeezing the clamping devices for fastening the computer plug connector to a computer socket connector. the plastic outer shell may be easily damaged.

SUMMARY OF THE INVENTION

A primary object of the present invention is to provide an improvement in computer plug connector fastening mechanisms in which a plug connector having two lateral slots can be easily and firmly connected with two clamp holders by engagement of grooves formed in the slots with hooked portions formed on the clamp holders.

Another object of the present invention is to provide an improvement in computer plug connector fastening mechanisms in which the clamp holders are each formed with an inward raised portion including an insertion hole, a through hole, and a stopper between the insertion and the through holes, such that two clamping devices can be easily and firmly connected thereto with a single simple movement.

A still further object of the present invention is to provide an improvement in computer plug connector fastening mechanisms in which the clamping devices each have a front hole to receive a corresponding protruded hook of the clamp holder therein so as to further secure the engagement of the clamp holder with the clamping device.

BRIEF DESCRIPTION OF THE DRAWINGS

The detailed structure, applied principles, functions, and performance of the present invention can be best understood through the following detailed description of the preferred embodiment and the accompanying drawings, wherein.

DETAILED DESCRIPTION OF THE PREFERRED EMBODIMENT

Figure 1:
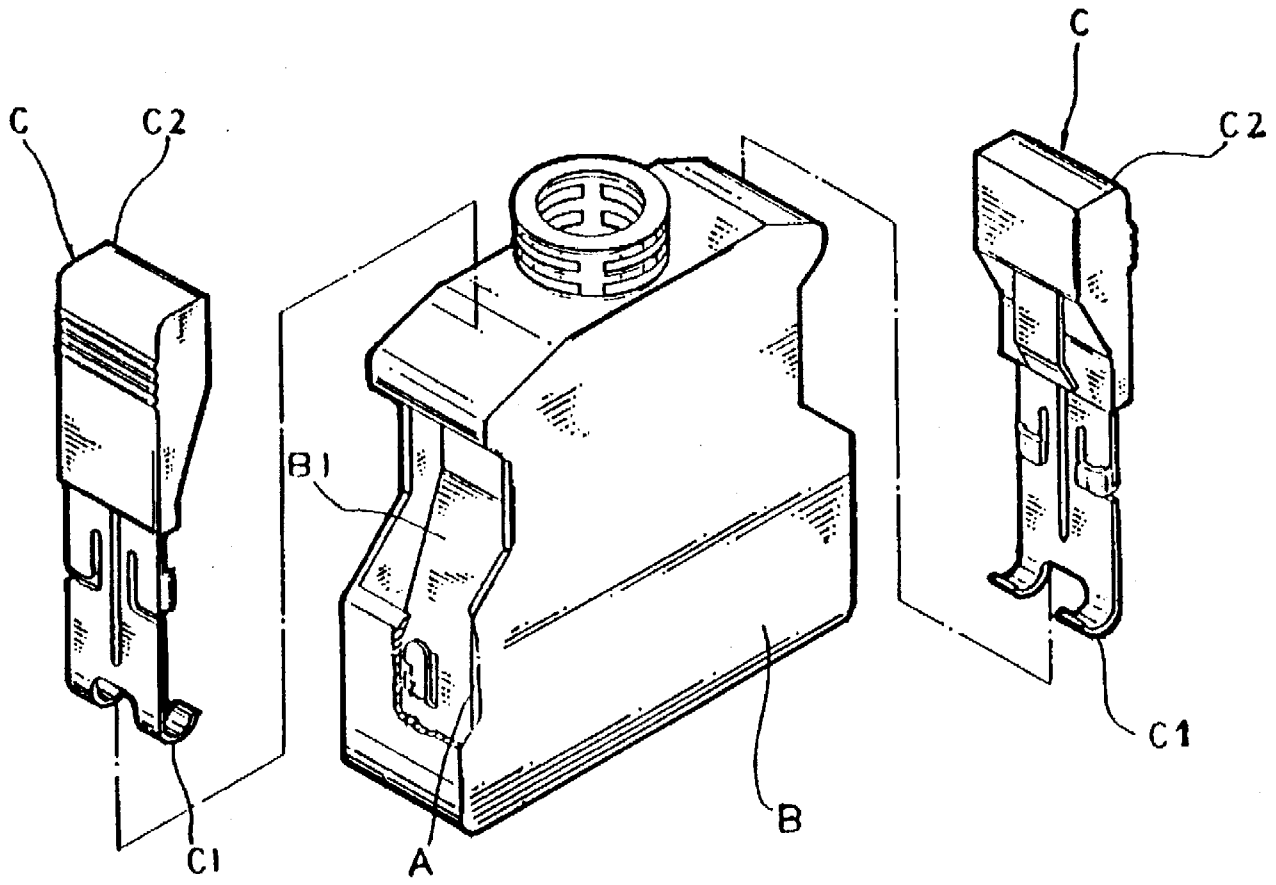
FIG.1 PRIOR ART
FIG. 1 is an exploded perspective view showing a first conventional computer plug connector fastening mechanism.
Figure 2:
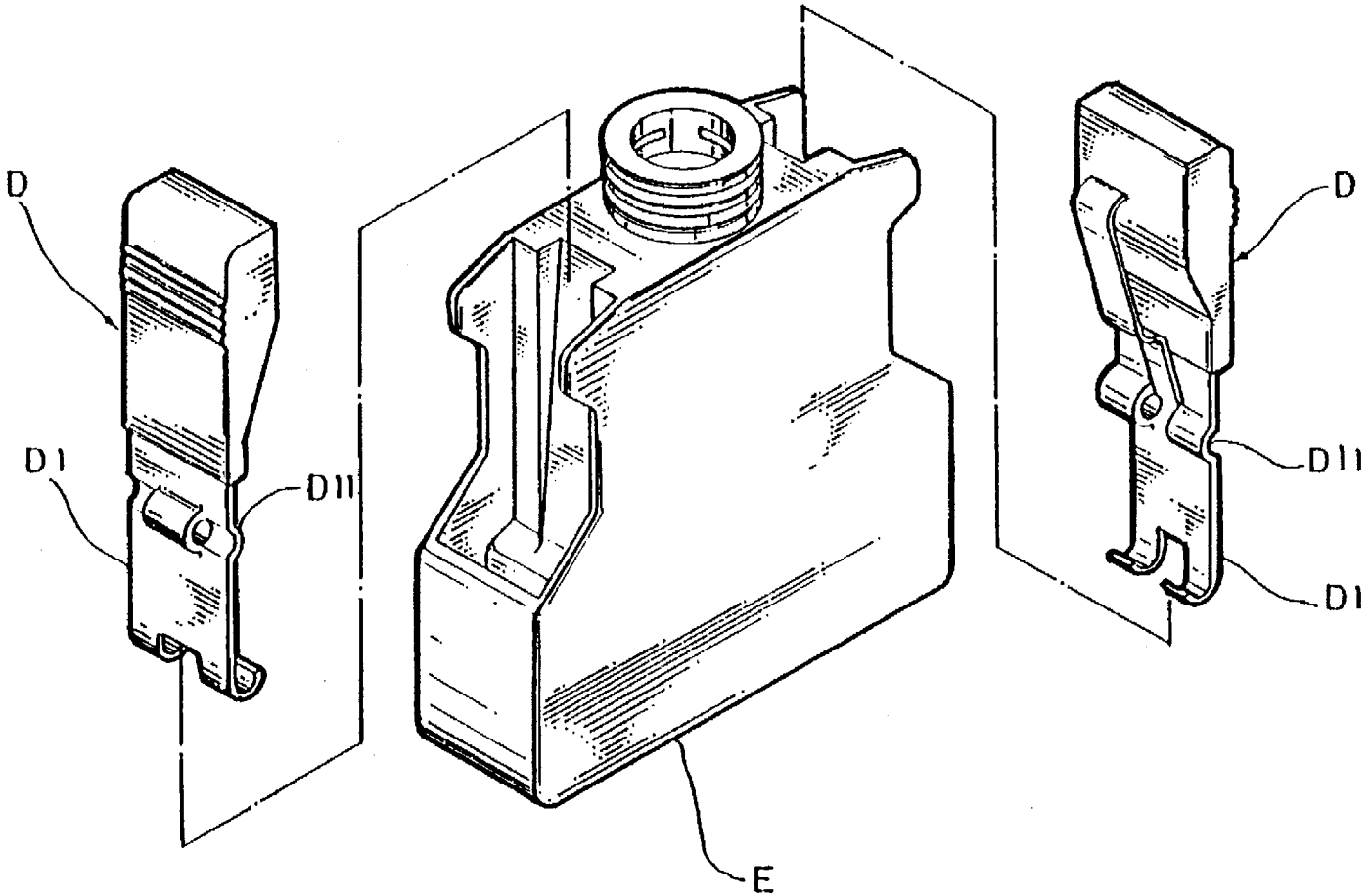
FIG.2 PRIOR ART
FIG. 2 is an exploded perspective view showing a second conventional computer plug connect fastening mechanism.
Figure 3:
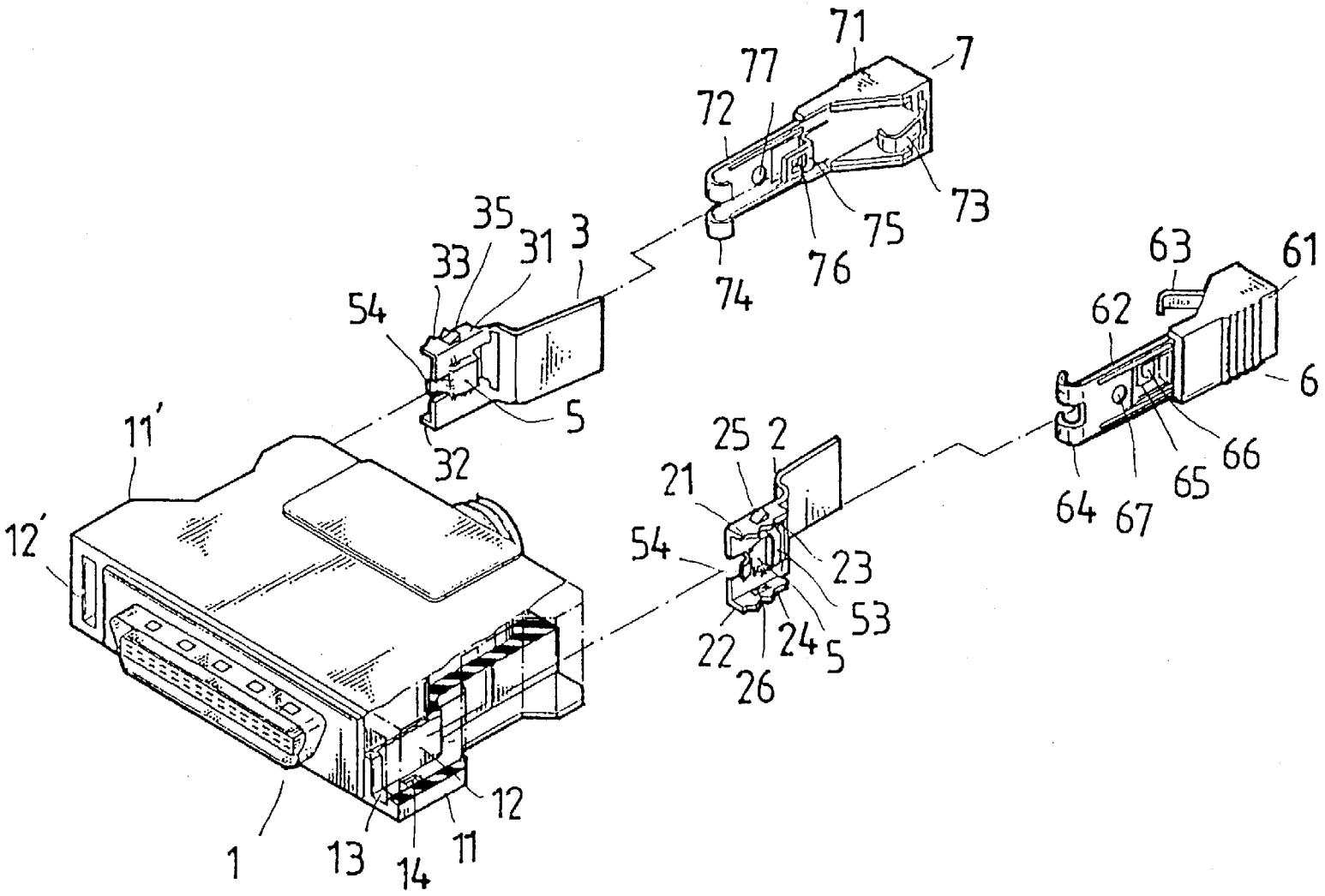
FIG. 3 is an exploded perspective view showing the computer plug connector fastening mechanism according to the present invention.

Referring to FIG. 3, a computer plug connector as constructed in accordance with the present invention is generally comprised of a main connector body 1, two clamp holders 2, 3, and two clamping devices 6, 7. The main connector body is comprised of a plastic outer shell 1 directly molded onto a metal casing. The connector body includes two frames 11, 11' on two apposing sides. The frames 11, 11' each include therein a rectangular slot 12 and 12'. Each frame 11 11' has a flange 13 and 13' around the rectangular slot 12 or 12' at the front end. Each framed 11 11' also includes two grooves 14, one in the bottom surface of the slot, and one in the top surface of the slot. (The groove 14 in the top surface of the slots 11 11' is not shown in the drawings).

Each clamp holder 2, 3 includes a front portion and an opposite rear portion and a central connecting portion. The clamp holder 2, 3 includes parallel side walls 21, 22 and 31, 32 respectively. The side walls extend outward substantially perpendicular to the front portion of the clamp holders 2, 3. The side walls have jagged outer edges 23, 24 and 33, 34. These side walls also have hooked portion 25,26 and 35, 36 that extend obliquely from the side walls. The clamp holders 2, 3 each also include at the front portion thereof a inwardly raised portion 5 which has an insertion hole 51, a through hole 52 between the insertion hole 51 and the rear portion of the clamp holder 2, 3, and a stopper 53 between the insertion hole 51 and the through hole 52. (See FIG. 4.) A free end of the raised portion 5 is substantially a hook 54 projecting outwardly from the raised portion 5.

Each clamping device 6, 7 comprises a plastic knob 61, 71 having a metal clamping plate 62, 72 at one end and a curved leaf spring 63, 73 at an opposite end. The metal clamping plate 62, 72 has a front end formed with two unitary claws 64, 74, and an L-shaped hook plate 65, 75 formed near a central portion of the metal plate 62, 72. The L-shaped hook plate 65, 75 extends towards the inner side of the clamping device 6, 7 respectively. An oblique hook 66, 76 is further provided on the plate 65, 75. Furthermore, holes 67, 77 are formed on the metal clamping plates 62, 72, respectively, at a position near the claws 64, 74 for respectively receiving the projected hooks 54 of the raised portions 5.

Figure 4:
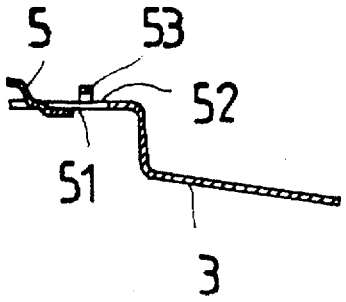
FIG. 4 is an sectional view of the clamp holder of the present invention.
Figure 5:
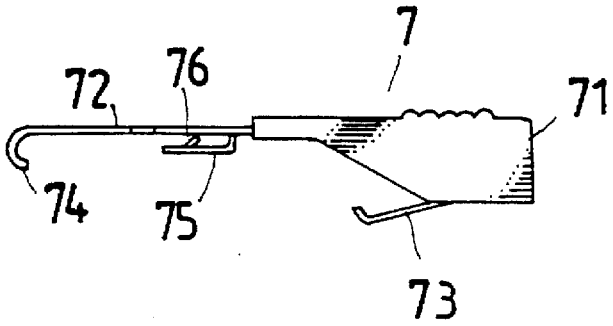
FIG. 5 is a side view of the clamping device of the present invention.
Figure 6:
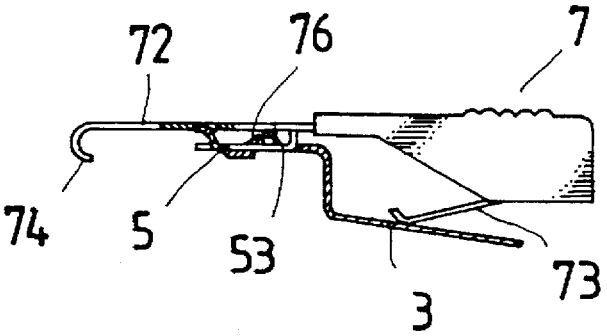
FIG. 6 is a side view showing the manner in which the clamp holder engages with the clamping device.

Please now refer to FIGS. 4, 5 and 6. To assemble the plug connector fastening mechanism according to the present invention, the two clamp holders 2, 3 are respectively inserted into the two slots 12, 12' in the connector outer shell 1 with each front end respectively stopped against the inward flange 13 or 13'. The hooked portions 25, 26; 45, 36 are respectively engaged into the inner wall surfaces of the frames 11 11'. Therefore, the two clamp holders 2, 3 are firmly fastened in the rectangular slots 12, 12' and are prohibited from moving forward or backward.

The jagged edges 23, 24; 33, 34 of the clamp holders 2, 3 further enhance the fixing of the clamp holders 2, 3 in the frames 11, 11'. The two metal clamping plates 52, 72 of the clamping devices 6, 7 are respectively inserted into the slots 12, 12' with the L-shaped hook plates 65, 75 respectively inserted into the through holes 52 on the raised portions. The oblique hooks 66, 76 of the L-shaped hook plates 65, 75 respectively pass the stoppers 53 and insert into the insertion holes 51 and are then retained by the stoppers 53 in the insertion holes 51. At the same time, the holes 67, 77 of the clamping devices 6, 7 respectively engage with the hooks 54 of the raised portions 5. Therefore, the clamping devices 6, 7 become secured to the two clamp holders 2, 3 inside the two opposite rectangular frames 11, 11'.

With the arrangement described above, the computer plug connector fastening mechanism according to the present invention can be easily and firmly assembled and the clamping devices thereof can be actively operated to the effect the connection of the plug connector to the socket connector. Therefore, the present invention effectively improves the conventional computer plug connection devices.

The present invention has been described in detail with particular reference to the preferred embodiments thereof, but it will be understood that variations and modifications can be made within the spirit and scope of the present invention as described hereinabove and as defined in the appended claims.

What is claimed is:

1. A computer plug connector fastening mechanism, comprising:

two frames formed on two opposing sides of an outer shell of said computer plug connector, said rectangular frames each including a rectangular slot having inner walls and having a flange around said rectangular slot at a front end thereof and two elongated grooves on internal top and bottom surfaces thereof;

two clamp holders received in said frames, each of said clamp holders comprising a metal plate having a front portion and a rear portion and including parallel side walls extending substantially perpendicular to said front portion, each of said walls having a jagged edge engaging one of said inner walls of said rectangular frames, and a hooked portion projected therefrom and received within one of said grooves formed in said slots, each of said metal plates also including at said front portion an inwardly raised portion disposed between said two side walls, each of said raised portions having an insertion hole, a through hole, and a stopper extending outwardly from said front portion and positioned between said walls, said raised portion also having a hook formed at a front and thereof and projecting outwardly therefrom; and two clamping devices respectively inserted through said slots in said frames and retained by said clamp holders, said clamping devices each having a plastic knob with a metal clamping plate connected to a first end and a curved leaf spring connected to a second end, said leaf spring being provided to engage said rear portion of said clamp holders, said metal clamping plates extending through said slots and each having an L-shaped hook plate near a central portion of said metal clamping plate such that said L-shaped hook plate extends toward an inner side of said clamping device, each of said L-shaped hook plates includes an oblique hook.

2. The computer plug connector fastening mechanism as claimed in claim 1, wherein;

each of said clamping devices has a hole formed near a front end of said metal clamping plate for receiving a corresponding projected hook of said raised portions of said clamp holders.

* * * * *